US005445581A

United States Patent [19]

Ferber

[11] Patent Number: 5,445,581

[45] Date of Patent: Aug. 29, 1995

[54] EXERCISE DEVICE

[76] Inventor: Dennis Ferber, 1884 N. El Camino Real, Suite 47, San Clemente, Calif. 92672

[21] Appl. No.: 267,063

[22] Filed: Jun. 27, 1994

[51] Int. Cl.[6] ..... A63B 23/14; A63B 21/015

[52] U.S. Cl. ..... 482/46; 482/118; 482/44; 482/115

[58] Field of Search ..... 482/44, 45, 46, 114, 482/115, 118

[56] References Cited

U.S. PATENT DOCUMENTS

| | | | |
|---|---|---|---|
| 2,668,055 | 2/1954 | Sharp et al. | 482/46 |
| 3,184,234 | 5/1965 | Struble | 482/118 |
| 3,211,453 | 10/1965 | Williams | 482/46 |
| 3,315,959 | 4/1967 | Carnielli | 482/118 |
| 3,516,661 | 6/1970 | Hansen | 482/115 |
| 4,203,591 | 5/1980 | Gibson | 482/46 |
| 4,374,588 | 2/1983 | Ruggles | 482/118 |
| 4,379,552 | 4/1983 | Webb et al. | 482/118 |
| 4,869,492 | 9/1989 | Joutras | 482/118 |
| 5,046,727 | 9/1991 | Wilkinson et al. | 482/118 |
| 5,167,596 | 12/1992 | Ferber | 482/114 |

*Primary Examiner*—Lynne A. Reichard
*Attorney, Agent, or Firm*—William Patrick Waters

[57] ABSTRACT

An exercise device having a coupling assembly attaching a pair of symmetrical, elongated arms mounted at right angles to each other. A pair of elongated handles, each one of which is mounted on one of the elongated arms, is provided for reversible rotation thereabout. Each of the handles has a tubular housing which includes a distal wall and a side wall, the distal wall having a coaxially disposed opening formed therein, the side wall having a pair of opposite longitudinal grooves formed on the inside thereof. Three openings are formed in the side wall.

A tubular socket member, adapted for rotation about a coupling assembly conical member includes a plurality of keys mounted longitudinally on its exterior wall, for registration with the tubular housing longitudinal grooves to enable cooperative rotational movement of the socket member. The tubular housing locking nubs protruding from the wall of the socket member frictionally engage the tubular housing side wall openings to prevent inadvertent disassembly of the device. An anti-rotation disc is fixed to an anti-rotation boss, the disc being received within the socket member distal end body portion. An elongated nut, disposed coaxially within the tubular housing, enables adjustment of handle rotation resistance. The nut includes a flange which has a diameter greater than the opening in the tubular housing distal wall. A finger engagable blade extends through the distal wall opening to enable adjustability. Spring means coaxially disposed between the elongated nut and the anti-rotation disc provide adjustable resistance to rotation. A frustoconical bushing is disposed between the conical member and the socket member cone shaped recess for frictional movement therebetween.

10 Claims, 3 Drawing Sheets

EXERCISE DEVICE

FIELD OF THE INVENTION

This invention relates generally to exercise devices and, more particularly, to hand held devices for exercise of the musculature of the wrists, forearms and arms.

BACKGROUND ART

The value of exercise in promoting and improving health is universally recognized. Health clubs and other organizations having equipment devoted to varying levels of exercise, from the benign to the arduous, have become popular. In general, such clubs serve a useful purpose by providing the opportunity for their members to exercise on a regular basis. A drawback, however, is the fact that in many cases, after paying a fee, members lose interest, move away or for other reasons quit visiting the club. Thus, it is recognized that it would be desirable to have exercise equipment which would be readily available to the user.

In addition to the unavailability of some exercise devices, another limitation is that they are often large, cumbersome and expensive. Because of recognition of a need for simpler, easily accessible exercise equipment, and in reaction to the limitations in some conventional devices, smaller, portable and significantly less expensive exercise devices have been developed. Some of these devices have great popular appeal. In order for such devices to function in an acceptable manner, it is highly desirable that, in addition to being portable and inexpensive, they are sturdy and not readily damaged.

Properly designed exercise devices, whether of the large fixed variety, or the smaller portable type, have certain common characteristics. Generally, they exercise single muscles, and muscle groups, by providing a resistance to movement which must be overcome by the user during exercise. Since a muscle or muscle group can exert power only upon contraction, muscle tissue is beneficially exercised when it contracts to overcome the resistance. During exercise, muscular contraction is followed by a brief period of relaxation, which in turn, is followed by contraction as the musculature moves once more against the resistance.

Because muscular strength varies from one person to the next and, indeed, may vary from time to time in the same individual, it is worthwhile to provide an exercise device having some adjustability in resistance. In this manner, users of varying age, strength and health can be benefitted from use of a single exercise device. In addition, it is desirable to provide adjustability of resistance for the individual who, over a period of use of the device, finds added strength requires increased resistance to provide a suitable challenge. Such adjustability is often readily achieved in large, fixed exercise devices where electrical controls, for example, can adjust a brake to load a flywheel. However, desired adjustability is substantially more difficult to achieve in a portable, hand held device. Thus, in view of the above mentioned benefits of portable exercise devices, it would be highly desirable to have such a device which would include a reliable adjustability capability.

A portable exercise device, disclosed in U.S. Pat. No. 5,167,596, relates to an articulated exercise device having a pair of handles connected by a telescopic crossbar. The device is compact, reliable and inexpensive. In addition to these features, it provides a capability for adjustment whereby the user, within certain limits, can vary the resistance within the device, thereby also varying the energy requirement for its operation. U.S. Pat. No. 5,167,596 is incorporated herein by reference as if set forth at full herein.

The portable exercise devices disclosed in the aforementioned patent are especially useful for conditioning large muscle groups of the body such as, for example, those of the torso, back and legs. However it has been found that in cases where conditioning of the wrists, forearms and arms is desired, a different approach would be desirable. In such a different approach, it would be advantageous to have a device which would be portable, compact and reliable, and would be suitable for conditioning the muscles of the upper body. Preferably, such a device would be easily assembled and resistant to disassembly upon repeated use.

As mentioned, U.S. Pat. No. 5,167,596 discloses several embodiments of exercise devices. In use, devices constructed according to the teaching of the patent have proved to have utility and, if used on a regular basis, provide the user with a suitable conditioning technique. Hoverer, experience in use of the devices has revealed certain limitations in them. For example, the devices have a capability of adjusting resistance over a broad spectrum, and it is not uncommon, as the user backs off a nut to lower resistance, a point is reached, when, without warning to the user, the device comes apart and its internal components spill out. In such a case, the device becomes worthless since the user is unschooled as to how the various components relate one to the other and the internal order in which they are assembled. As a result, the user is often unable to reassemble the device and the disabled device is discarded. In view of this limitation, it would be highly advantageous to have an exercise device which was adjustable over a broad range of resistance levels without risk of damage thereto.

A corollary limitation to that of the possibility of the device coming apart under certain conditions is the fact that the devices disclosed in the aforesaid patent are difficult to assemble even by an experienced individual. The difficulty of assembly results from the fact that numerous components must be aligned in a precise order and then carefully inserted into the handle. The result is a complex installation operation which is time consuming and expensive. In view of this consideration, it would be highly desirable to provide a portable exercise device which is simple in design and easy to assemble.

DISCLOSURE OF INVENTION

It is an object of the present invention to provide a portable exercise device.

It is another object of the present invention to provide an exercise device primarily for conditioning the muscles of the wrist, forearm and arm.

It is a further object of the present invention to provide an exercise device which is compact, inexpensive and convenient to use.

It is a still further object of the present invention to provide an exercise device having cooperating structural elements assembled in such a manner as to resist disassembly during use.

It is still another object of the present invention to provide an exercise device having resistance adjustment characteristics to permit muscle conditioning in a wide spectrum of users.

Briefly, the above and further object of the present invention are realized by providing an exercise device having a coupling assembly attaching a pair of symmetrical, elongated arms mounted at right angles to each other. A pair of elongated handles, each one of which is mounted on one of the elongated arms, is provided for reversible rotation thereabout. Each of the handles has a tubular housing which includes a distal wall and a side wall, the distal wall having a coaxially disposed opening formed therein, the side wall having a pair of opposite longitudinal grooves formed on the inside thereof. Three openings are formed in the side wall.

A tubular socket member, adapted for rotation about a coupling assembly conical member includes a plurality of keys mounted longitudinally on its exterior wall, for registration with the tubular housing longitudinal grooves to enable cooperative rotational movement of the socket member. The tubular housing locking nubs protruding from the wall of the socket member frictionally engage the tubular housing side wall openings to prevent inadvertent disassembly of the device. An anti-rotation disc is fixed to an anti-rotation boss, the disc being received within the socket member distal end body portion. An elongated nut, disposed coaxially within the tubular housing, enables adjustment of handle rotation resistance. The nut includes a flange which has a diameter greater than the opening in the tubular housing distal wall. A finger engagable blade extends through the distal wall opening to enable adjustability. Spring means coaxially disposed between the elongated nut and the anti-rotation disc provide adjustable resistance to rotation. A frustoconical bushing is disposed between the conical member and the socket member cone shaped recess for frictional movement therebetween.

The present invention affords several advantages. For example, the locking nub feature holds the assembly together thereby preventing accidental disassembly of the device. Thus, the frictional resistance within the exercise device can be lowered to a minimum, by backing off the elongated adjustment nut, without concern that the device will come apart. This presents a significant advantage over conventional exercise devices in which an adjustment nut can be unscrewed until the device falls apart. Another advantage of the present invention is seen in easier assembly of the device because of cooperation between the socket assembly keys and the tubular housing side wall grooves.

In addition, the present invention is comprised of relatively few components. For example, cup shaped washers are utilized to provide frictional resistance and the need for springs is eliminated. As a result, the exercise device of the present invention is reliable, compact, inexpensive and highly suitable for its intended purpose.

BRIEF DESCRIPTION OF DRAWINGS

The above mentioned and other objects and features of this invention and the manner of attaining them will become apparent and the invention itself will be best understood by reference to the following description of the embodiment of the invention in conjunction with the accompanying drawings, wherein.

BEST MODE FOR CARRYING OUT THE INVENTION

Figures 1, 4:
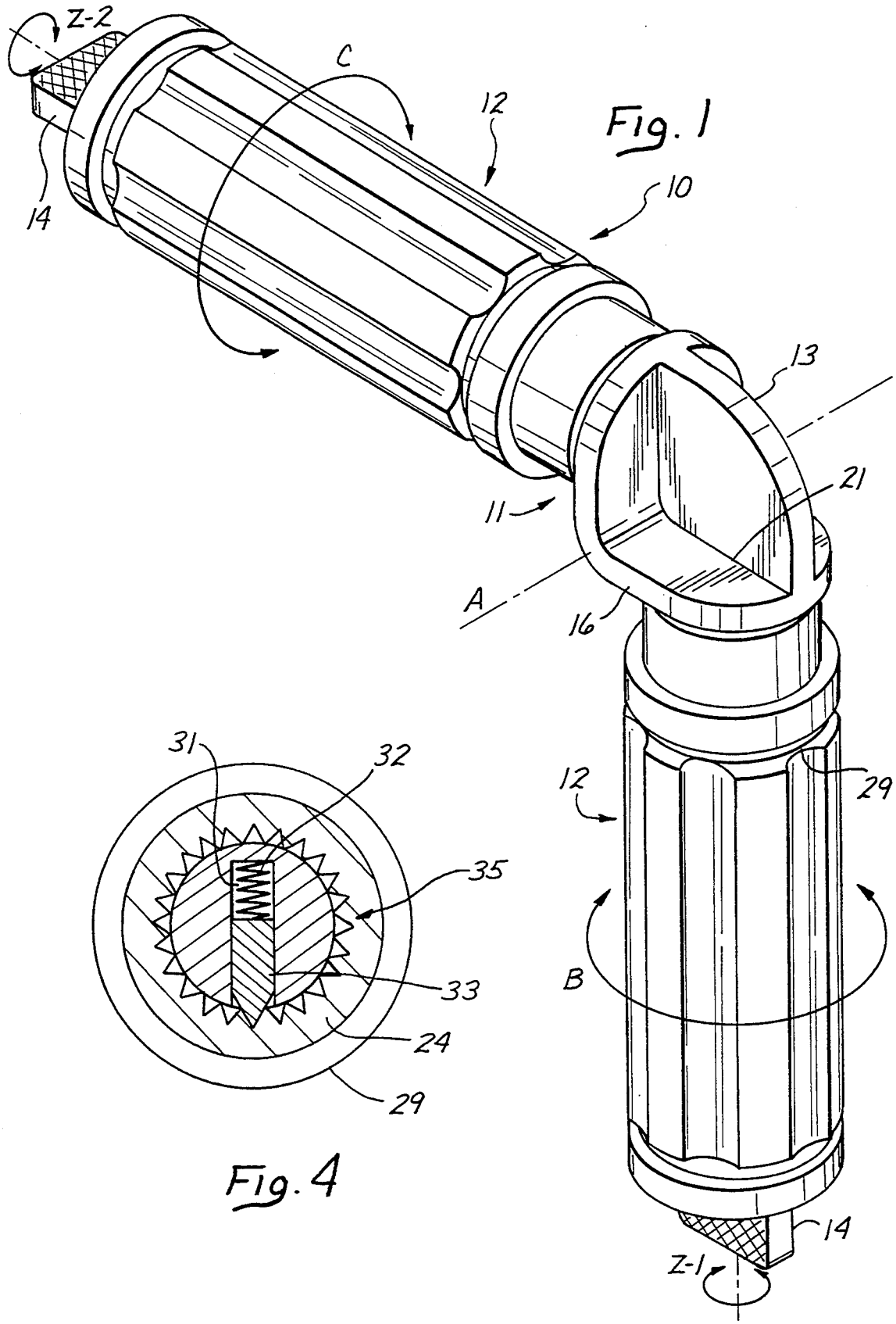
FIG. 1 is a perspective view of an exercise device of the present invention.
FIG. 4 is a section taken along the line 4—4 of FIG. 2.

Referring now to the drawings, and particularly to FIG. 1 thereof, there is shown a novel portable, hand operated exercise device 10 which is constructed according to the present invention. The device 10 is comprised generally of a pair of elongated handle assemblies 12, disposed generally at a right angle one to the other and connected by a coupling assembly 11 at a shoulder 13.

Figures 2, 5:
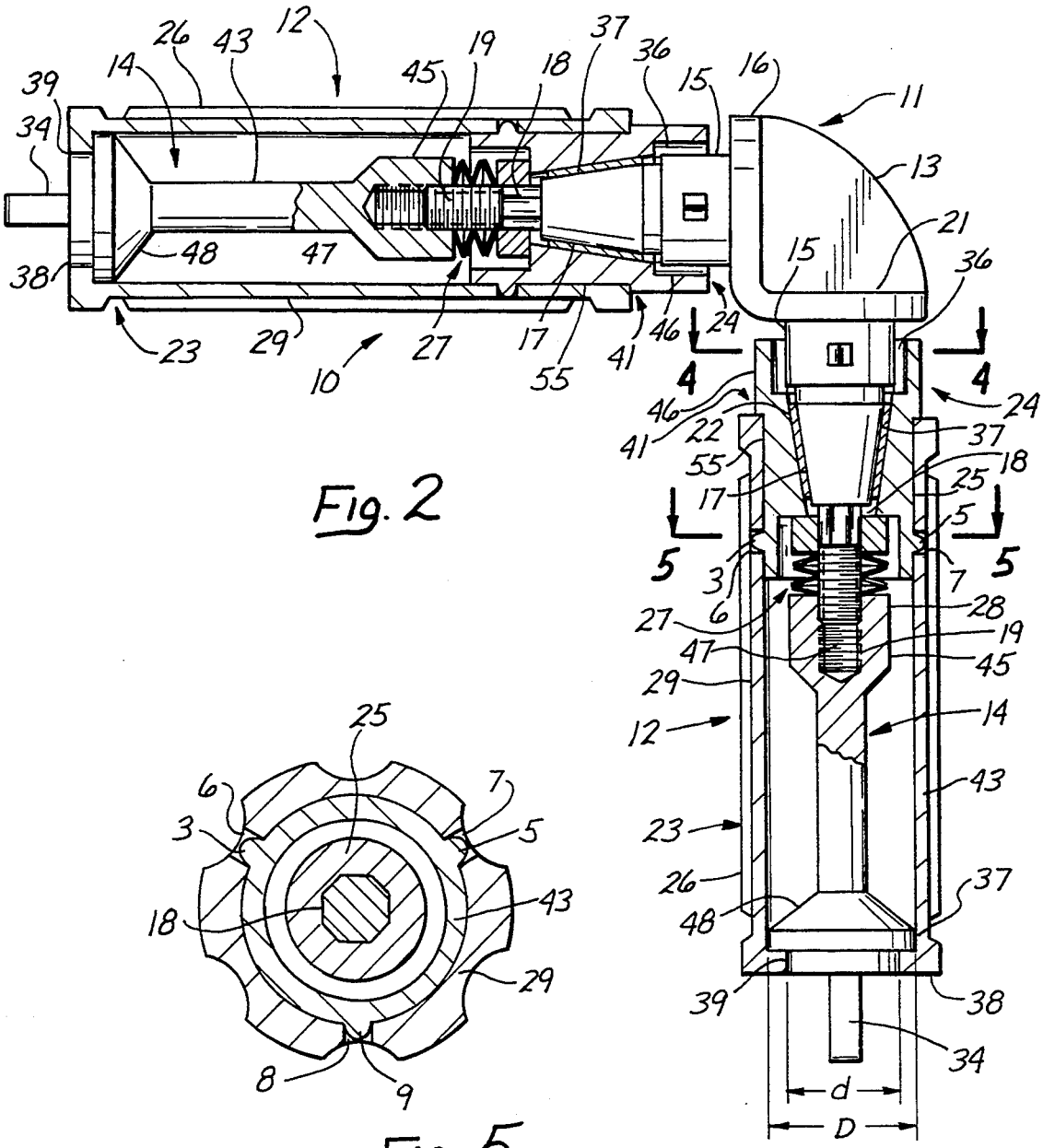
FIG. 2 is a side view in section of the exercise device depicting the internal components thereof.
FIG. 5 is a section taken along the line 5—5 of FIG. 2.

An examination of FIGS. 1 and 2 will reveal that the exercise device 10 is comprised of two portions which are perfectly symmetrical on either side of an imaginary line A, drawn through the shoulder 13. Thus, while the components of one half of the device 10 are described herein in detail, it is to be understood that the discussion applies with equal effect to identical components in the other symmetrical half.

In operation, the user grasps one handle assembly 12 with one hand while the other handle assembly 12 is grasped by the other hand. As discussed in more detail below, exercise is performed when the user rotates the handle assemblies as depicted, respectively, by the arrows B and C, about their respective longitudinal axes Z-1 and Z-2. A finger operated blade 34 can be tightened or loosened to increase or decrease torque resistance of the handle assembly 12. In this manner, the user can increase or decrease resistance to rotation in the individual handle assemblies.

It will be readily appreciated by those skilled in the art that the capability of resistance adjustment in the handle assemblies enables beneficial use of the device 10 by users of varying strengths. In addition, since the resistance levels of the two handle assemblies are separately and individually adjustable, the user can vary the resistance if strength on one side of the body differs from that on the other. Further, it will be appreciated that utilization of the device 10 can significantly benefit the muscles and muscle groups of the hands, wrists, forearms and arms.

Figure 3:
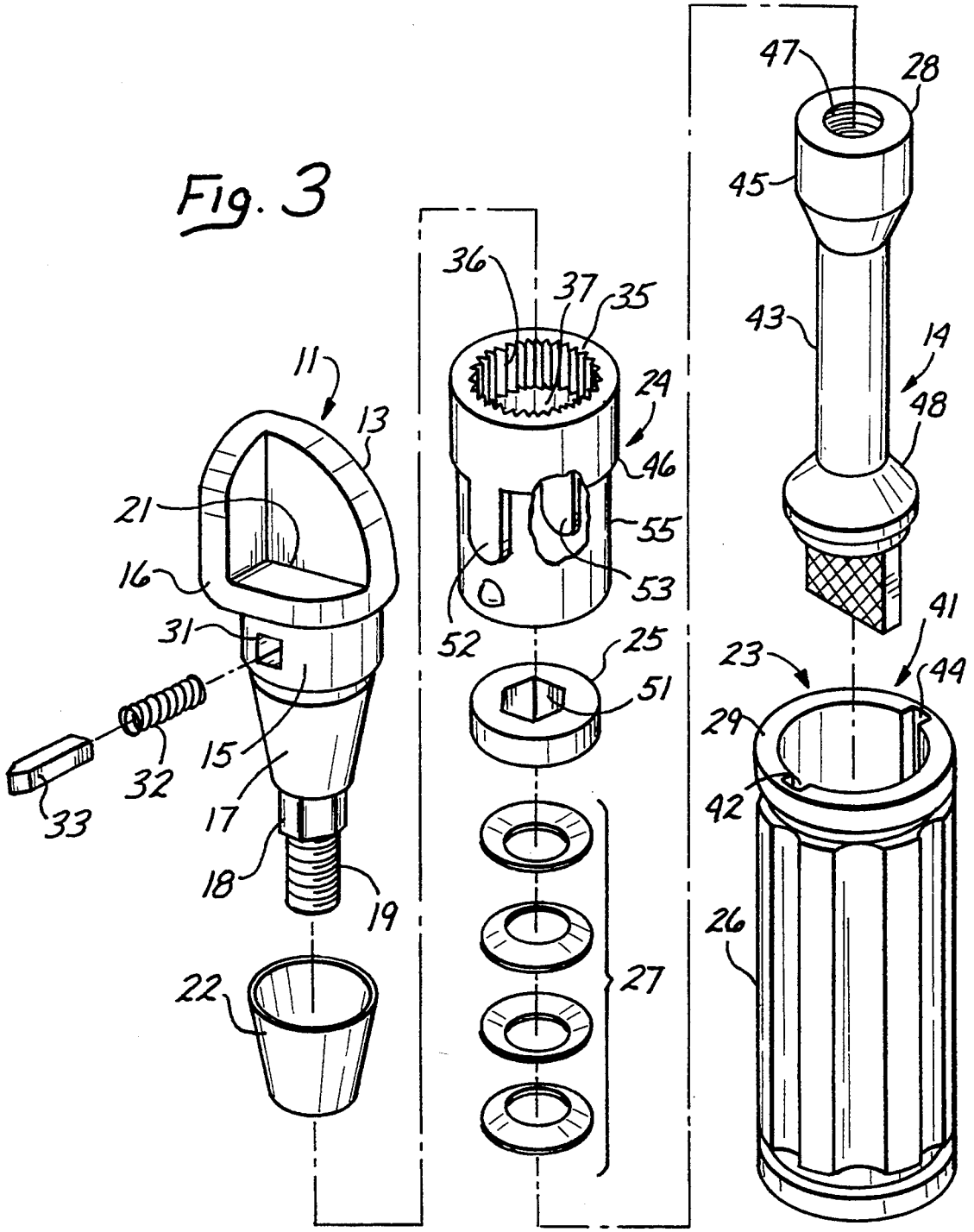
FIG. 3 is an exploded perspective view of a handle assembly of the exercise device.

The operation of the exercise device 10 will be more clearly understood by reference now to FIGS. 2–5. As shown in FIGS. 2 and 3, the handle assemblies 12 are connected together by the coupling assembly 11 at the shoulder 13. The coupling assembly 11 may be formed from a single block of suitable material such as, for example Durethan BKV 130. The shoulder 13 is integrally joined along an inside edge 21 to a flange 16 thereby providing strength to the device 10 and preventing separation of one handle from the other during use. Moving distally from the flange 16, the coupling assembly 11 includes a body portion 15, a conical member 17 tapering distally, and a boss 18. The boss 18 is octagonally shaped in cross section. Extending distally from the boss 18 is a threaded rod 19.

The body portion 15 of the coupling assembly 11 has a generally square shaped radially opened recess 31 for receipt of a compression spring 32 and a pawl 33. The pawl 33 is generally square in cross section and it fits snugly into the recess 31. As more fully seen in FIG. 4, the pawl engages serrations, such as the serrations 35 arranged circumferencially along the inner wall 36 of a collar 46 located at the proximal end of a cone socket 24, to produce a clicking sound during operation of the exercise device 10. Distally from the collar 46, the cone socket 24 includes a body portion 55 having formed on its inside a recess 37 for receipt therein of the conical member 17. A pair of oppositely located keys 52 and 53 project distally from the collar 46 along the outer wall of the body portion 45.

Considering now the handle assembly 12 in greater detail, the assembly includes a tubular housing 23 having a side wall 29 and a distal end wall 38. The end wall 38 has an opening 39 formed therein. The tubular housing 23 is covered over a substantial portion thereof by a ribbed rubber grip 26. Three nub receptacles 6,7 and 8, equidistant from the end wall 38, are formed in the side wall 29. The openings are spaced at intervals of 120 degrees. At the proximal end 41 of the tubular housing 23 a pair of opposed grooves 42 and 44 are formed on the inside of the side wall 29.

In use of the exercise device 10, rotational resistance can be adjusted by turning an elongated nut 14 which is coaxially disposed within the tubular housing 23. The nut 14 includes a shaft 43 which connects, at its proximal end, to a body portion 45 and, at its distal end, to a distally radially tapered flange 48. The body portion 45 includes a threaded recess 47 for receipt of the threaded rod 19.

A washer assembly 27 is interposed between the nut 14 and the body portion 55 of the socket 24. The washers of the assembly 27 are cup shaped and they provide adjustable frictional resistance to rotation of the handle assembly 12. During use of the device 10, the washer assembly 27 is urged adjustably against an anti-rotation disc 25. The disc 25 has an octagonally shaped opening formed therein so that the disc 25 can be fixed on the boss 18. The diameter of the disc 25 is slightly smaller than the diameter of the cone socket body portion 55 within which it is located upon assembly of the device 10. During rotation of the handle assembly 12, a floating cone bushing 22, interposed between the conical member 17 and the cone socket recess 37 provides smooth rotational movement.

Considering now the features of the present invention for prevention of accidental disassembly, it will be noted that the devices disclosed in U.S. Pat. No. 5,167,596, are susceptible to such disassembly if the adjustment nut is backed off too far. In such cases, without warning, the device comes apart and its components spill out.

In the present invention, the likelihood of such accidental disassembly is eliminated by virtue of cooperation between the flared flange 48 on the elongated nut 14, the nubs 3, 5 and 9 and the nub receptacles 6, 7 and 8. Referring to FIG. 2, it will be seen that the flange 48 has a diameter D which is larger than the diameter d of the opening 39 in the distal wall 38 of the tubular housing 23. Thus, even if the nut 14 were to be backed off as far as possible, the flange 48 would prevent the nut 14 from passing out of the handle assembly 12 through the opening 39. It will be recognized, however, that the flange/opening (D/d) relationship alone is not enough to prevent inadvertent disassembly since nut 14 could be unscrewed from the threaded rod 19 until the two parted and there would be nothing then holding the handle assembly 12 together. In the present invention, however, the threaded rod 19 and the nut 14 are prevented from parting by the cooperation of the nubs 3, 5 and 9 with the tubular housing side wall nub receptacles 6, 7 and 8, respectively. After assembly of the exercise device 10, the seated nubs prevent separation of the threaded rod 19 and the nut 14 by limiting the distance of travel therebetween.

Thus, as a result of the cooperation among elements of the tubular housing, the socket assembly and the elongated nut, problems and limitations of conventional exercise devices are eliminated by the present invention in a novel and nonobvious manner.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise device comprising:

a coupling assembly having a shoulder and a symmetrical pair of elongated arms mounted on said shoulder at right angles to each other, each one of said pair of arms having an integral body portion, a conical member disposed distally thereto, an integral anti-rotation boss disposed distally in relation to said conical member and an integral threaded rod disposed distally to said boss;

a pair of elongated handles, each one of which is mounted on one of said elongated arms for reversible rotation about the longitudinal axis thereof, each one of said handles having a tubular housing, said housing including a distal wall and a side wall wherein said distal wall has a coaxial opening formed therein, and said side wall has at least one longitudinal groove on the inside thereof and at least one opening formed therein;

a tubular member having a collar at its proximal end and a body portion at its distal end, said collar including a recess for receipt therein of said conical member for rotational movement thereabout and said body portion having at least one key mounted longitudinally on the exterior wall thereof and at least one locking nub protruding radially therefrom, wherein said key is held in registration with said tubular housing longitudinal groove for cooperative rotational movement of said socket member when said tubular housing is rotated and said at least one locking nub frictionally engages said at least one side wall receptacle to prevent inadvertent disassembly of said exercise device;

an anti-rotation disc fixed to said boss, said disc being received within said socket member distal end body portion;

an elongated nut disposed coaxially within said tubular housing, said nut having a threaded recess at its proximal end for threaded engagement with said threaded rod and a flange at its distal end, said flange having a diameter greater than the diameter of said housing distal wall opening, said elongated nut further having a finger engagable blade extending through said distal wall opening;

spring means coaxially disposed between said elongated nut and said anti-rotation disc for frictional engagement therewith; and a frustoconical bushing disposed between said conical member and said socket member for frictional rotational movement therebetween.

2. An exercise device according to claim 1 further including a plurality of locking nubs.

3. An exercise device according to claim 1 further including three locking nubs disposed at about 120 degree intervals on said tubular housing side wall.

4. An exercise device according to claim 1 further including a pair of socket member keys and a pair of tubular housing side wall grooves formed therein for relative registration therewith.

5. An exercise device according to claim 1 wherein said tubular socket member includes a proximal collar portion and an integral distal body portion.

6. An exercise device according to claim 5 including a plurality of keys extending distally from said collar portion along said body portion.

7. An exercise device according to claim 1 including a resilient grip disposed over the sides of said tubular housing.

8. An exercise device according to claim 1 wherein said spring means includes a plurality of cup shaped washers.

9. An exercise device according to claim 1 wherein said spring means includes four cup shaped washers.

10. An exercise device according to claim 1 including means for producing an audible sound during operation.

* * * * *